US006712079B2

(12) United States Patent
Bredo et al.

(10) Patent No.: US 6,712,079 B2
(45) Date of Patent: Mar. 30, 2004

(54) PROCESS OF CLEANING THE INNER SURFACE OF A WATER-CONTAINING VESSEL

(75) Inventors: Katia Bredo, Brussels (BE); Alejandro Cedeno, Loveland, OH (US); Nicolas Rémy Denis Pochart, Brussels (BE); Michela Ratti, Rome (IT); Joris Jozef Gustaaf Tack, Keerbergen (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/965,111

(22) Filed: Sep. 26, 2001

(65) Prior Publication Data

US 2002/0112742 A1 Aug. 22, 2002

(51) Int. Cl.[7] ..... B08B 3/08; B08B 9/00

(52) U.S. Cl. ..... 134/22.1; 134/22.16; 134/22.17; 134/22.19

(58) Field of Search ..... 134/18, 22.1, 22.18, 134/22.19, 22.17, 22.16, 23, 24, 169 R; 210/242.1, 169

(56) References Cited

U.S. PATENT DOCUMENTS 5,108,514 A * 4/1992 Kisner ..... 134/22.1
5,682,628 A 11/1997 Oleson
6,294,084 B1 * 9/2001 Henkin et al. ..... 210/143

FOREIGN PATENT DOCUMENTS

| | | | |
|---|---|---|---|
| AU | A-715978 | * | 2/2000 |
| DE | 297 09 738 | * | 9/1997 |
| JP | 2-143199 A | * | 6/1990 |
| JP | 9-187388 A | * | 7/1997 |
| JP | 2000093338 A | * | 4/2000 |
| WO | WO 94/23159 | * | 10/1994 |

* cited by examiner

*Primary Examiner*—Randy Gulakowski
*Assistant Examiner*—Saeed Chaudhry
(74) *Attorney, Agent, or Firm*—Thibault Fayette; Kim William Zerby; Steven W. Miller

(57) ABSTRACT

The present invention relates to a process of cleaning the inner surfaces of a liquid-containing vessel with an automatic cleaning device, wherein said process is performed by said device and comprises the steps of applying a cleaning composition onto at least portions of the inner surfaces of said liquid-containing vessel and rinsing at least portions of the inner surfaces of said liquid-containing vessel and wherein said automatic cleaning device is a non-floating device (8) placed on the bottom of said vessel.

11 Claims, 4 Drawing Sheets

PROCESS OF CLEANING THE INNER SURFACE OF A WATER-CONTAINING VESSEL

TECHNICAL FIELD

The present invention relates to a process of cleaning the inner surfaces of a liquid-containing vessel. More particularly, the present invention relates to a process of cleaning the inner surfaces of a liquid-containing vessel with an automatic cleaning device.

BACKGROUND OF THE INVENTION

Liquid-containing vessels, preferably water-containing vessels, such as swimming pools and bathtubs, are prone to soiling. Indeed, soap-scum, limescale and other residues, such as hair and body grease, are deposited on the inner surfaces of a bathtub after use. Furthermore, the inner surfaces of swimming pools can be covered with algae, fungi and other deposits. Thus, there is a need to clean such surfaces on a frequent basis. In particular, the inner surface of a bathtub should preferably be cleaned after each use of said bathtub to avoid the build-up and/or encrustation of soap-scum, limescale, mineral deposit, mildew and other residues, such as hair and body grease, on the bathtub surface. Although, swimming pool surfaces have to be cleaned on a less frequent basis, there is nevertheless a need to clean such swimming pool surfaces at least once a month to prevent the build-up of an algae- and/or fungi-cover.

Cleaning compositions used to clean bathtubs and/or swimming pools are well known in the art. Such compositions can be either liquids, such as sprays, foams or gels, or solid, such as scouring powders. For example, WO 92/21772 describes acidic liquid detergent compositions for bathrooms. Even though, some of these cleaning compositions provide cleaning performance upon contact with the surface to be cleaned, without employing manual action, it is in most cases required that the cleaning of the inner surface of a bathtub, swimming-pool or any other vessel for liquid, requires, to at least some extent, manual action by a person cleaning said vessel.

It is well known from consumer research that the cleaning of liquid-containing vessels is a laborious and unpleasant task for the person cleaning said vessel. Indeed, to clean a bathtub, the person cleaning said bathtub has to bend over the rim of the bathtub, go on his/her knees and/or reach far into the tub to reach all parts of the bathtub with a suitable cleaning implement, as for example a sponge, cloth or brush. Furthermore, in order to clean the inner surfaces of a swimming pool, it is necessary to climb into the pool and brush the surfaces of the pool once it has been emptied. Therefore, there is a constant need for improvement in the field of cleaning the inner surfaces of a liquid-containing vessel, such as bathtubs and swimming pools.

It is therefore an objective of the present invention to provide a process for cleaning the inner surfaces of a liquid-containing vessel, such as bathtubs and swimming pools, which is more convenient for the person that has to clean said surfaces. Indeed, it is the objective of the present invention to provide an easy way of cleaning such surfaces.

It has now been found that the above objective can be met by process of cleaning the inner surfaces of a liquid-containing vessel with an automatic cleaning device, according to the present invention.

An advantage of the process as described herein is that said process provides an effective way of cleaning the inner surfaces of a liquid-containing vessel, such as bathtubs and swimming pools.

Another advantage of the process as described herein is that said process can easily be used by persons of a wide range of age. Indeed, said process can be used by children or persons that usually would not clean the inner surfaces of a liquid-containing vessel, such as bathtubs and swimming pools.

A further advantage of the preferred embodiment of the present invention wherein the liquid-containing vessel is a bathtub, is that the process herein enables the person taking a bath to clean the bathtub instantly after taking the bath. By contrast, in most households a person taking a bath would otherwise simply walk away from the bathtub and leave it to the individual that is usually doing the household work to clean the bathtub. By this time the dirt and soil, as for instance soap-scum, limescale and other residues, such as hair and body grease, remaining in the bathtub after being drained may already have built-up or be encrustated, which in turn makes cleaning of the bathtub even more laborious.

BACKGROUND ART

DE 297 09 738 U describes a self-propelled, solar cell powered water-surface cleaning device. The device is equipped with a pump, a filter and a water-jet.

WO 94/23159 describes a device and method for cleaning surfaces in a pool. The device is battery powered and equipped with either a propeller or a turbine and spray nozzles to apply water and/or a cleaning solution onto the pool surfaces. Furthermore, the device is equipped with brushes.

AU-A-715978 describes a swimming pool cleaning device equipped with a water-jet, spray nozzles and a filter.

JP 9-187388 describes a floating bathtub cleaning robot that is mains-powered and sprays a cleaning composition onto the bathtub surfaces. Furthermore, the robot is equipped with brushes and a propeller.

JP 2-143199 describes a floating wall surface cleaning robot equipped with two propulsion means and a sponge. In addition, the robot sprays a cleaning composition onto surfaces to be cleaned.

SUMMARY OF THE INVENTION

The present invention encompasses a process of cleaning the inner surfaces of a liquid-containing vessel with an automatic cleaning device, wherein said process is performed by said device and comprises the steps of applying a cleaning composition onto at least portions of the inner surface of said liquid-containing vessel and rinsing at least portions of the inner surface of said liquid-containing vessel and wherein said automatic cleaning device is a floating device (1) actively moving in said vessel or is a non-floating device (8) placed on the bottom of said vessel.

In a preferred embodiment the process according to the present invention is a process of cleaning a bathtub or a swimming pool, preferably a bathtub.

In another preferred embodiment according to the present invention, the liquid in the liquid-containing vessel comprises water.

In yet another preferred embodiment herein, said automatic cleaning device additionally comprises a feature selected from the group consisting of: an energy storage means, a filter, a reservoir for a cleaning composition, a means to move in said vessel, a spray nozzle (2), a rudder (7), a motor and a pump, and combinations thereof.

BRIEF DESCRIPTION OF THE DRAWINGS

Whilst the specification concludes with claims which particularly point out and distinctly define the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
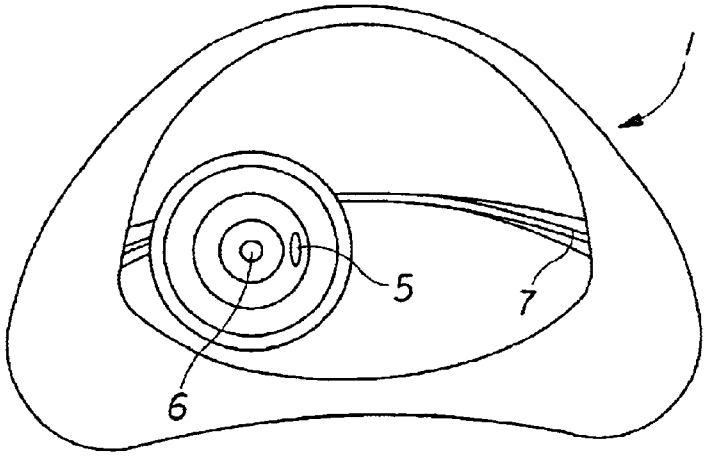
FIG. 1 is an outside bottom-view of a floating device (1), suitable for cleaning liquid-containing vessels, according to the present invention.

The present invention encompasses a process of cleaning the inner surfaces of a liquid-containing vessel with an automatic cleaning device, wherein said process is performed by said device and comprises the steps of applying a cleaning composition onto at least portions of the inner surface of said liquid-containing vessel and rinsing at least portions of the inner surface of said liquid-containing vessel and wherein said automatic cleaning device is a floating device (1) actively moving in said vessel or is a non-floating device (8) placed on the bottom of said vessel.

By "liquid-containing vessel" it is meant herein, any container capable of holding a liquid, preferably water. Preferably, said liquid-containing vessel holds more than 0.05 $m^3$ of liquid, more preferably more than 0.1 $m^3$, even more preferably more than 0.2 $m^3$, and most preferably more than 0.5 $m^3$. The liquid-containing vessels herein may be any container for liquids known to those skilled in the art. Preferably, the liquid-containing vessels herein are selected from the group consisting of bathtubs, pools, in particular swimming pools, reactors, liquid storage tanks, aquarium tanks, chemical processing equipment, fuel tanks, and the like. More preferably, the liquid-containing vessels herein are selected from the group consisting of bathtubs and swimming pools. Most preferably, the liquid-containing vessel herein is a bathtub. The liquid-containing vessel herein may hold any kind of liquid. Preferably, the liquid in said liquid-containing vessel is water, fuel, a wash solution, and the like. In a preferred embodiment wherein the liquid-containing vessel herein is a bathtub, the liquid herein comprises water and optionally a personal cleansing composition or shampoo. Furthermore, the liquid may comprise hair, body grease, soap-scum and the like dissolved and/or dispersed therein.

By "liquid-containing" it is meant herein, that at the beginning of the cleaning process as described in the present invention at least some liquid is present in the liquid-containing vessel described herein above. Preferably, at the beginning of the cleaning process herein the liquid-containing vessel is filled with at least 10%, preferably at least 25%, more preferably at least 50%, even more preferably at least 60%, and most preferably at least 75%, of its total capacity of liquid. During the process described herein the level of liquid in the liquid-containing vessel may increase, decrease or remain essentially constant.

In a preferred embodiment of the present invention, the liquid-containing vessel is at least partially filled with liquid and the level of liquid in the liquid-containing vessel decreases during the process of cleaning a liquid-containing vessel as described herein. Preferably, the liquid-containing vessel is cleaned during the process of emptying said liquid-containing vessel. More preferably, at the end of the process described herein, the liquid-containing vessel is essentially completely drained, most preferably completely drained, of the liquid. By "essentially completely drained" it is meant herein, that the vessel holds less than 5%, preferably less than 1%, of its total capacity of liquid.

By "inner surfaces of the vessel" it is meant herein, the surfaces of the vessel that may be exposed to the liquid present in said vessel. For example, in the preferred embodiment wherein the vessel herein is a pool, the walls and the floor of said pool, or in the preferred embodiment wherein the vessel herein is a bathtub the vertical, horizontal and curved inner surfaces of the bathtub. Said inner surfaces of the vessel herein may be made of any kind of material known to those skilled in the art. Preferably, said surfaces are: ceramic surfaces; enamel surfaces; glazed tiles; vinyl surfaces; no-wax vinyl surfaces; linoleum; melamine; glass; any plastics; plastified wood surfaces; metal surfaces such as steel, stainless steel, chromed surfaces; or any painted or varnished or sealed surface and the like.

Process

According to the present invention the process herein is performed by an automatic cleaning device, as described herein below, and comprises the steps of applying a cleaning composition onto at least portions of the inner surface of said liquid-containing vessel and rinsing at least portions of the inner surface of said liquid-containing vessel and wherein said automatic cleaning device is a floating device (1) actively moving in said vessel or is a non-floating device (8) placed on the bottom of said vessel.

Preferably, the inner surfaces of the vessel herein are rinsed with liquid present in the vessel, and wherein more preferably, the liquid is filtered before used to rinse said inner surfaces.

The process herein comprises the steps of applying a cleaning composition onto at least portions of the inner surface of said liquid-containing vessel and rinsing at least portions of the inner surface of said liquid-containing vessel. Preferably, the step of applying a cleaning composition onto at least portions of the inner surface of said liquid-containing vessel is performed before the step of rinsing at least portions of the inner surface of said liquid-containing vessel. In a preferred embodiment, further steps may be performed before, in between and/or after any of the two steps of the process as described herein.

Alternatively, the steps of applying a cleaning composition onto at least portions of the inner surfaces of said liquid-containing vessel and rinsing at least portions of the inner surfaces of said liquid-containing vessel may be repeated for several times.

The steps in the process according to the present invention are performed by the automatic cleaning device described herein, in particular, the step of applying a cleaning composition onto at least portions of the inner surfaces of said liquid-containing vessel and the step of rinsing at least portions of the inner surfaces of said liquid-containing vessel are performed by the device described herein. The Applicant has now found that by performing the steps of cleaning the inner surfaces of a liquid-containing vessel with an automatic cleaning device provides an easy and convenient way of cleaning such vessels. Indeed, said process can be used by children or persons that usually would not clean the inner surfaces of a liquid-containing vessel, such as bathtubs and swimming pools. Furthermore, in the preferred embodiment of the present invention wherein the liquid-containing vessel is a bathtub, the process herein enables the person taking a bath to clean the bathtub instantly after taking the bath. By contrast, in most households a person taking a bath would otherwise simply walk away from the bathtub and leave it to the individual that is usually doing the household work to clean the bathtub. By this time the dirt and soil, as for instance soap-scum, limescale and other residues, such as hair and body grease, remaining in the bathtub after being drained may already have built-up or be encrustated, which in turn makes cleaning of the bathtub even more laborious.

Automatic Cleaning Device

The process of cleaning the inner surfaces of a liquid-containing vessel is performed by an automatic cleaning device. By "automatic cleaning device" it is meant herein, a device, such as a robot, that is capable of performing the process steps of the process according to the present invention. Said device comprises all the means necessary to perform the steps according to the present invention.

In a preferred embodiment herein, said automatic cleaning device performs the steps of the process herein in an autonomous way, once said device is started or put into action by the user of said device ("switched on"). Indeed, after the automatic cleaning device according to the present invention is switched on and/or placed into the water-containing vessel, it is capable of performing the steps according to the present invention without further intervention by its user. Preferably, the automatic cleaning device herein is programmed and/or constructed to perform the steps of the process herein. The set of instructions to perform the steps of the process herein may be provided in any form known to those skilled in the art, preferably programmed in a single microprocessor or set thereof, preferably present in said device.

Alternatively, the automatic cleaning device herein may be remote controlled by its user with a radio operated controlling device or with a controlling device that is connected to the automatic device herein via a cable connection.

In a highly preferred embodiment herein, the device herein will switch on by itself without the requirement of an intervention of the user other than placing the device into the liquid-containing vessel. Preferably, the device herein is equipped with a means to detect when it is placed into the liquid-containing vessel. A suitable means detect when it is placed into the liquid-containing vessel may be a water sensor.

Alternatively, the automatic cleaning device herein may be equipped with a means to switch said device on or off by the user of the device. Suitable means to switch said device on or off by the user are push button switches, or any other electrical switches known to those skilled in the art.

In a preferred embodiment herein, the devices according to the different embodiments of present invention, may stop automatically after a preset time or due to a user intervention, this means that a user of the device manually switches the device off.

The devices according to the different embodiments of the present invention may be equipped with an energy storage means. By "energy storage means" it is meant herein any means known to those skilled in the art to store energy. The energy to be stored in said energy storage means may be electric energy, therefore said means may be a disposable battery or a rechargeable battery pack, such as an accumulator. Alternatively, the energy to be stored in said energy storage means may be kinetic energy, therefore said means may be a mechanical clockwork equipped with a spring and/or a gear. Said energy storage means may act as a power source for the devices herein.

Alternatively, the devices according to the different embodiments of present invention may be mains powered.

Preferably, the devices according to the different embodiments of the present invention are battery powered and are more preferably equipped with a disposable battery or a rechargeable battery pack.

In order to be able to apply a cleaning composition onto the inner surfaces of the liquid-containing vessel herein and/or rinsing the inner surfaces of said liquid-containing vessel, the device herein may be equipped with a spray nozzle (2) or a set of spray nozzles. Each spray nozzle (2) herein has at least one aperture through which liquids, as for example the cleaning composition, can be dispensed or discharged. The spray nozzle (2) or set of spray nozzles herein are preferably located on the automatic cleaning device in a way that allow the application of liquids targeted onto the inner-surface to be most efficient.

In a preferred embodiment herein, the devices according to the different embodiments of the present invention herein are equipped with a set of spray nozzles (2), preferably two or more spray nozzles (2), and more preferably three spray nozzles (2). More preferably, said devices are equipped with a set of spray nozzles (2) mounted onto a rotating spray head (4). By "rotating spray head" it is meant herein, a circular shaped support for the set of spray nozzles (2) that is capable of rotating around its axis and therefore allows for the better distribution of the cleaning composition dispensed by the set of spray nozzles (2) and/or the liquid used to rinse the inner surfaces of said liquid-containing vessel. Preferably, said rotating spray head (4) may start and/or stop rotating during the process of cleaning a liquid-containing vessel described herein. Indeed, said rotating spray head (4) may be fixed during certain steps of the process of cleaning herein.

The automatic device herein may be equipped with a pumping means that allows to pump the cleaning composition herein and the liquid used to rinse the inner surface of the vessel herein. The pumping means herein is preferably an electrically operated pump. The electrically operated pump may be, for example, a gear pump, an impeller pump, a piston pump, a centrifugal pump, a screw pump, a peristaltic pump, a diaphragm pump, or any other miniature pump. In a highly preferred embodiment the electrically driven pump for use herein is a centrifugal pump or impeller pump with a typical flow-rate of from 100 $ml*min^{-1}$ to 5000 $ml*min^{-1}$, preferably from 2000 $ml*min^{-1}$ to 3000 $ml*min^{-1}$ and preferably operating at a pressure of from 500 mbar to 1000 mbar. The electrically driven pump is driven by an electric motor, which typically produces a torque of between 1 and 75 mN*m, preferably 1 and 50 mN*m.

The electric motor, when present, must in turn be provided with a power source. The power source may be the energy storage means as described herein above and/or mains power. Preferably, the power source is the energy storage means as described herein above. In case said energy storage means is a means to store electric energy, said power source may either a disposable battery or rechargeable battery pack, as described herein above. In case said energy storage means is a means to store kinetic energy, said power source may be a mechanical clockwork in combination with a power generator.

The automatic cleaning device herein may also be equipped with a reservoir or container for the cleaning composition. The cleaning composition reservoir preferably holds sufficient cleaning composition to allow the complete cleaning of the vessel to be cleaned in the process according to the present invention. In a preferred embodiment wherein the device herein is used to clean a bathtub, the cleaning composition reservoir may hold up to 100 ml, preferably from 10 ml to 60 ml, more preferably from 15 ml to 40 ml, of cleaning composition. In a preferred embodiment wherein the device herein is used to clean a liquid-containing vessel that holds significantly more water than a bathtub such as a swimming pool or a fuel tank and the like, the cleaning composition reservoir may hold up to 10 l, preferably from 500 ml to 6 l, of cleaning composition. The automatic cleaning device herein may be equipped with an inlet (3) to fill up the cleaning composition reservoir, when present.

It is preferred that the spray nozzle (2) or set of spray nozzles, when present, the cleaning composition reservoir, when present, and the pumping means, when present, communicate with each other. This means that these different parts are interconnected with each other for example with flexible connectors, in order to allow the dispensing of the cleaning composition in the cleaning composition reservoir through the pumping means to the spray nozzle (2) or set of spray nozzles.

In the preferred embodiment herein wherein the inner surfaces of the vessel herein are rinsed with liquid present in the vessel, the automatic cleaning device herein may further be equipped with an inlet (6) for the liquid. By "inlet" it is meant herein, an opening for intake of liquid. Preferably, said inlet (6) is combined with, more preferably covered by, a filter allowing the filtration of the liquid used for the rinsing step of the process herein.

Suitable filters for use herein may be expanded thermally bonded polymer fibers such as polypropylene (PP), polyethylene terephthalate (PET), or cellulosic material or combinations thereof. The liquid is pumped or taken up from the vessel to be cleaned through an inlet (6) covered by a filter. The use of a filter prevents that particles present in the liquid, such as hair, leafs, solid residues and the like, can enter the device and in turn reduce the performance and/or the operation reliability of the pump, when present, or the spray nozzle (2), when present, or even jam up the pump, when present, or the spray nozzle (2), when present.

Furthermore, it is preferred that the spray nozzle (2) or set of spray nozzles the filter, when present, the inlet (6), when present, and the pumping means, when present, communicate with each other. This means that these different parts are interconnected with each other for example with flexible connectors, in order to allow the dispensing of the liquid through the pumping means to the spray nozzle (2) or set of spray nozzles to rinse the inner surface of the vessel herein.

In the preferred embodiment herein, wherein the liquid-containing vessel is cleaned whilst it is being emptied and the inner surfaces of the vessel herein are rinsed with liquid present in the vessel, the process of cleaning herein ends after a final rinsing step. In order for the automatic cleaning device to have sufficient levels of rinsing liquid left for the final rinsing step, the automatic cleaning device may be equipped with a rinse-liquid storage reservoir. Preferably, said rinse-liquid storage reservoir is filled with rinse-liquid at a time when the vessel is not yet drained. More preferably, said rinse-liquid storage reservoir, when present, is interconnected with the spray nozzle (2) or set of spray nozzles, when present, the filter, when present, and the pumping means, when present preferably by means of flexible connectors.

Preferably, the rinse-liquid reservoir holds sufficient rinse-liquid to allow the complete rinsing of the vessel to be cleaned in the process according to the present invention.

In the preferred embodiment, wherein the device herein is a floating device (1), the rinse-liquid reservoir may hold up to 1500 ml, preferably from 10 ml to 500 ml, more preferably from 15 ml to 200 ml, even more preferably 20 ml to 150 ml, still more preferably 50 ml to 150 ml, and most preferably 100 ml to 150 ml of rinse-liquid. In a preferred embodiment wherein the floating device herein is used to clean a liquid-containing vessel that holds significantly more water than a bathtub such as a swimming pool or a fuel tank and the like, the rinse-liquid reservoir may hold up to 10 l, preferably from 500 ml to 6 l, of rinse-liquid.

In the preferred embodiment, wherein the device herein is a non-floating device (8), the rinse-liquid reservoir may hold up to 2000 ml, preferably from 10 ml to 2000 ml, more preferably from 15 ml to 1500 ml, even more preferably 20 ml to 1500 ml, still more preferably 50 ml to 1500 ml, and most preferably 100 ml to 1500 ml of rinse-liquid. In a preferred embodiment wherein the non-floating device herein is used to clean a liquid-containing vessel that holds significantly more water than a bathtub such as a swimming pool or a fuel tank and the like, the rinse-liquid reservoir may hold up to 10 l, preferably from 500 ml to 6 l, of rinse-liquid.

In a highly preferred embodiment herein, the liquid-containing vessel is drained during the process of cleaning and said process comprises: a first step wherein a cleaning composition is applied onto the inner surfaces of the liquid-containing vessel herein and/or the inner surfaces of said liquid-containing vessel are rinsed, and wherein preferably said cleaning composition and/or a rinse liquid are discharged through spray nozzles (2) mounted on a rotating spray head (4), which is not rotating, meaning it is fixed; and a second step wherein a cleaning composition is applied onto the bottom-surface of the liquid-containing vessel herein and/or the bottom-surface of said liquid-containing vessel is rinsed, wherein preferably said cleaning composition and/or a rinse liquid are discharged through spray nozzles (2) mounted on a rotating spray head (4), which is rotating.

Floating Device

In a preferred embodiment according to the present invention, said automatic cleaning device is a "floating device" (1) actively moving in said vessel.

Figure 2:
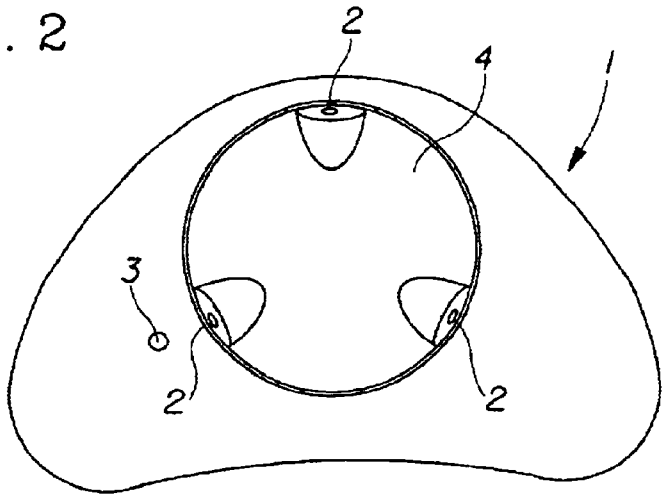
FIG. 2 is an outside top-view of a floating device (1), suitable for cleaning liquid-containing vessels, according to the present invention.
Figure 3:
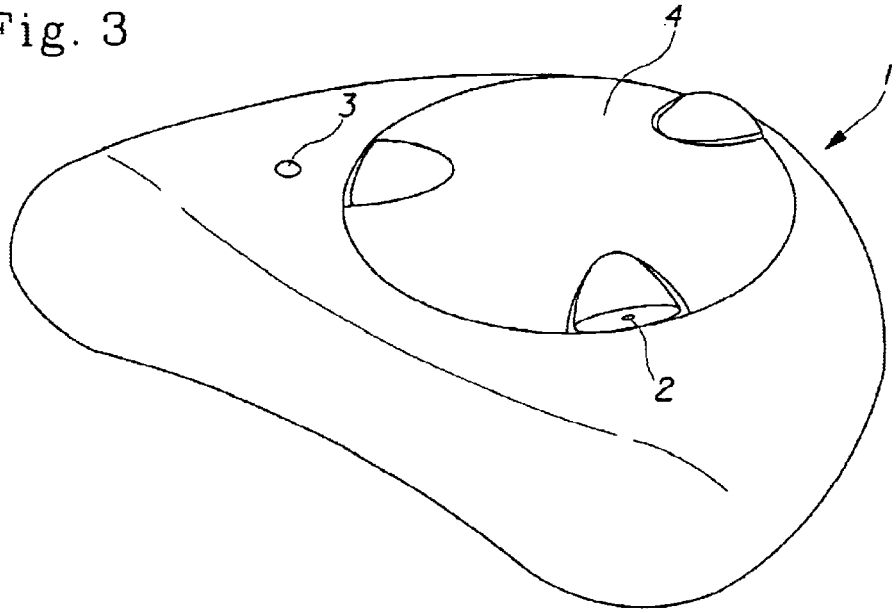
FIG. 3 is a perspective outside top-view of a floating device (1), suitable for cleaning liquid-containing vessels, according to the present invention.

FIGS. 1 to 3 relate to this preferred embodiment according to the present invention.

Said floating device (1) herein is placed on the surface of the liquid in the liquid-containing vessel herein and actively moves in said vessel, preferably it actively moves along the sidewalls of the vessel. To perform the movement in said vessel the device (1) is equipped with a means to actively move the device in said vessel. In a preferred embodiment herein, said active movement in the vessel is an active movement along the walls of the vessel.

By "actively moving" it is meant herein, that the movement of the floating device (1) in the liquid-containing vessel is substantially caused by the floating device (1) itself and not by any outside force such as currents of the liquid present in the vessel or by manual interaction, as for example pushing or pulling, by the user of the device.

The floating device (1) according to the present invention may be equipped with a means to actively move the floating device (1) in the liquid-containing vessel. By "means to actively move the device" it is meant herein any means known to those skilled in the art to capable of moving said device in the liquid-containing vessel, this means, the floating device (1) herein are self-propelled.

Any means to actively move the floating device (1) according to the different embodiments of the present invention in said vessel may be used herein. Suitable, means to actively move the device in said vessel are, for example, turbines, water-jets, propellers, and the like.

In the preferred embodiment herein, wherein the liquid-containing vessel is being emptied or drained during the process according to the present invention, the active movement stops as soon as the vessel is essentially completely drained of the liquid. Preferably, prior to the stopping of the movement of the device herein, the floating device (1) steers or is steered to the center of the liquid-containing device to be cleaned.

Preferably, said means capable to actively move the device in said vessel is a water-jet, wherein a directed stream of liquid, discharged through a nozzle or a set thereof ("jet-nozzle"), is used to move the floating device (1) in the vessel. The jet-nozzle (5) or set thereof is preferably located in the portion of the device that is immersed in the liquid, this means in the part of the floating device (1) facing the surface of the liquid or on the side of the floating device (1). The jet-nozzle (5) or the set thereof preferably point in the direction opposite to the direction in which the floating device (1) will move when the spray of liquid is discharged through the jet-nozzle (5) or set thereof. The stream of liquid may either be discharged on a constant level or may be a series of discharges.

The liquid to be discharged through the jet-nozzle (5) is preferably the liquid present in the liquid-containing vessel and the automatic cleaning device (1) herein may therefore further be equipped with an inlet for the liquid. Preferably, said inlet (6) is combined with, more preferably covered by, a filter allowing the filtration of the liquid before being discharged through the jet-nozzle (5) or set thereof.

The inlet may either be the same inlet (6) as described herein above to provide the rinsing liquid or may be an additional inlet with the sole purpose of providing the liquid to be discharged through the jet-nozzle (5). The filtration may either be performed by the filter as described herein above for the filtration of the rinsing liquid or may be an additional filter with the sole purpose of filtration of liquid to be discharged through the jet-nozzle (5).

The stream of liquid to be discharged through the jet-nozzle (5) or set thereof is preferably created using a pumping means that is present in said floating device (1). This pumping means may be the same pumping means as described herein above used to spray the cleaning composition onto the inner surfaces of said liquid-containing vessel and/or rinse the inner surfaces of said liquid-containing vessel or may be an additional pumping means with the sole purpose of providing the stream of liquid to be discharged through the jet-nozzle (5).

It is preferred that the jet-nozzle (5) or set of jet-nozzles, the filter, when present, and the pumping means, when present, communicate with each other. This means that these different parts are interconnected with each other for example with flexible connectors, in order to allow the dispensing of the liquid through the pumping means to the jet-nozzle (5) or set of jet-nozzles to rinse the inner surface of the vessel herein.

Furthermore, it is preferred in the preferred embodiment wherein the device (1) herein is a floating device (1), that the spray nozzle (2) or set of spray nozzles, when present, as described herein above are located in the portion of the device that is not immersed in the liquid, this means in the part of the device not facing the surface of the liquid or on the side of the floating device (1).

By "floating" it is meant herein, that the floating devices (1) herein remain at least partially above the surface level of the liquid present in the vessel to be cleaned.

In order for the floating device (1) to be floating, it has a lower specific weight than liquid present in the vessel allowing the floating device (1) to float on the surface of said liquid. The floating device (1) may be partially immersed into the liquid, whereby certain parts of the device are under the surface-level of the liquid, as for example, the filter, when present, and the means to move the device, such as a jet-nozzle (5) or a set thereof, when present, and other parts of the device are above the surface-level of the liquid, as for example, the spray nozzles (2), when present. The floating characteristics of the floating automatic cleaning device (1) herein may be adjusted by balancing the weight distribution in the device accordingly. For example, the relative heavy battery pack, when present, may be located in that part of the device that is immersed into the liquid, this means is located under the surface-level of the liquid. Furthermore, the device may be equipped with a floating chamber. Preferably, said floating chamber is filled with air or any other compound that has a lower specific weight than water and is preferably located in a part of the device that is located above the surface-level of the liquid.

In the preferred embodiment herein, wherein the device is a floating device (1), said device (1) may further be equipped with a rudder (7). By "rudder (7)" it is meant herein, a wing or fin allowing to stabilise and/or steer the movement of the floating device herein. Said rudder (7) may either be fixed or variable, in order to achieve the desired steering and/or stabilisation of the movement.

The floating device (1) herein may additionally be equipped self-tracking means.

By "self-tracking means" it is meant herein a means that allows a directed movement of the device herein as compared to a random movement.

In a highly preferred embodiment herein the floating device (1) according to the present invention, moves along the inner sidewalls of the vessel to be cleaned. Even more preferably, the floating device herein moves along the inner side walls of the vessel to be cleaned during the emptying of said vessel, prior to the substantially complete drainage the vessel moves to the center of the vessel and subsequently stops its movement in the center of the vessel. Preferably, the self-tracking devices herein are equipped with a steering sensor, such as infra-red proximity sensors, in order to locate the center of the vessel.

Suitable self tracking means herein may be selected from: the combination of a means to actively move the device and a rudder (7) attached to the device; the combination of a means to actively move the device and balancing the center of gravity of the device in the region of the device that remains in contact with inner side walls of the vessel; the combination of a means to actively move the device and balancing the center of gravity of the device in the vicinity of said means to actively move the device; and the combination of a means to actively move the device and a spray nozzle (2), spraying a cleaning solution and/or a rinse liquid onto the inner side walls of the vessel; and combinations thereof.

Non-Floating Device

In another preferred embodiment according to the present invention, said automatic cleaning device is a "non-floating device" placed on the bottom of said vessel.

Figure 4:
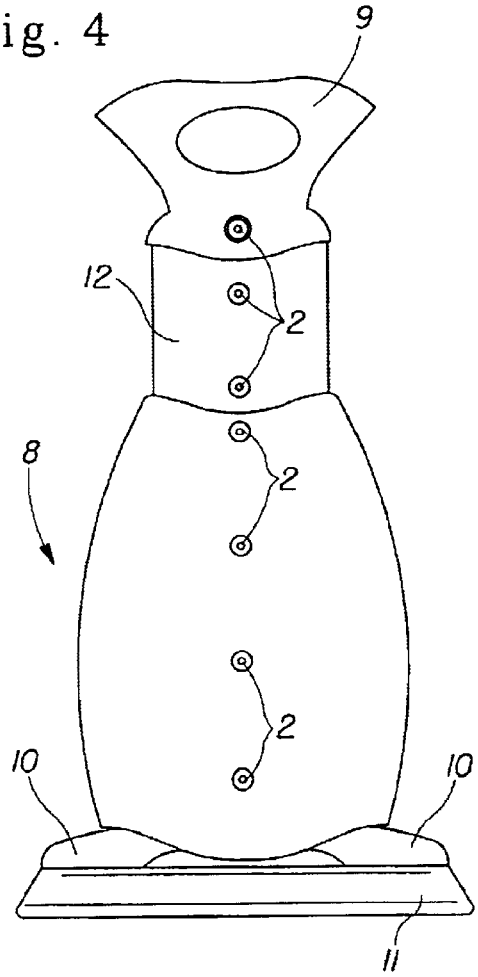
FIG. 4 is an outside front-view of a non-floating device (8), suitable for cleaning liquid-containing vessels, according to the present invention and a docking station (11) for said device.
Figure 5:
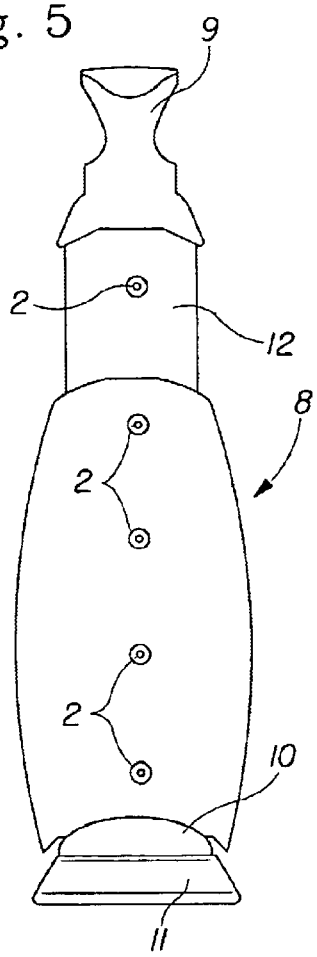
FIG. 5 is an outside side-view of a non-floating device (8), suitable for cleaning liquid-containing vessels, according to the present invention and a docking station (11) for said device.
Figure 6:
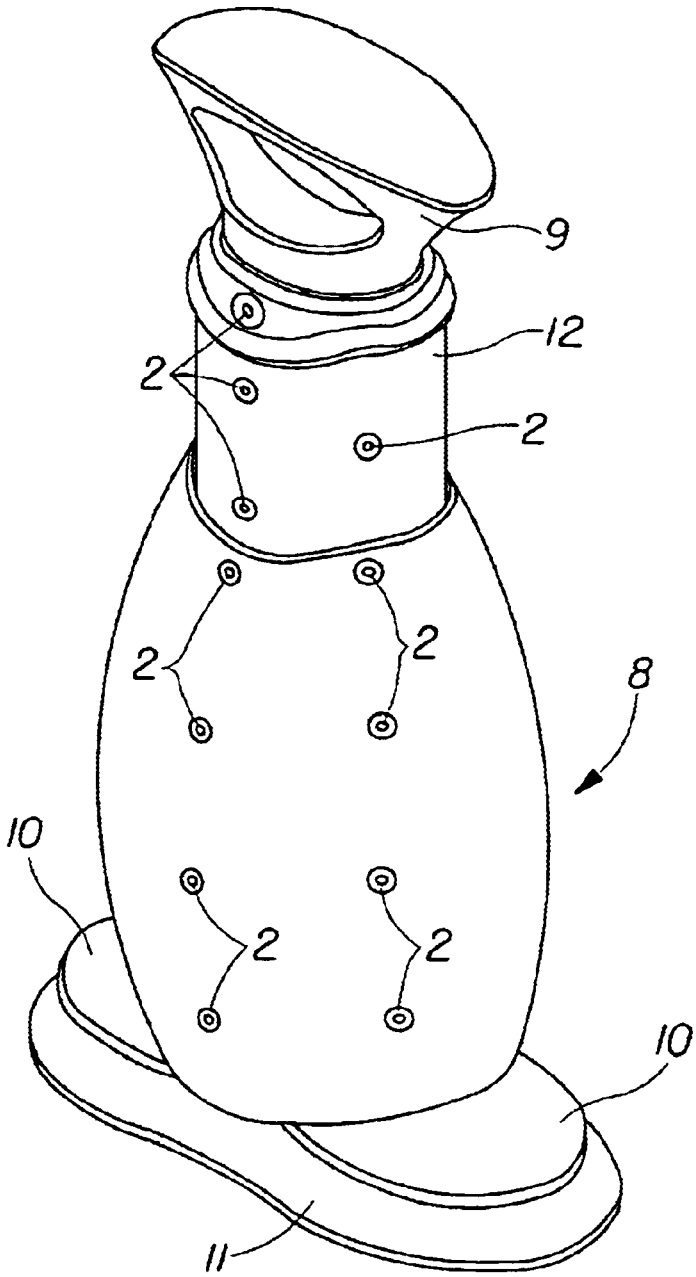
FIG. 6 is a perspective outside top-view of a non-floating device (8), suitable for cleaning liquid-containing vessels, according to the present invention and a docking station (11) for said device.

FIGS. 4 to 6 relate to this preferred embodiment according to the present invention.

The non-floating automatic cleaning device (8) herein remains static on the place where it has been initially placed. Preferably, the non-floating devices (8) herein are placed on the bottom of the liquid-containing vessel to be cleaned and are thus at the beginning of the cleaning process at least partially immersed in the liquid present in the vessel.

By "static" it is meant herein that the non-floating devices (8) herein do not actively move in the liquid-containing vessel to be cleaned, this means that the non-floating devices (8) herein are not equipped with a means to move the non-floating devices (8), such as a propeller and the like. Indeed, the devices herein are not self-propelled.

In order for the non-floating devices (8) to be non-floating in the liquid present in the liquid-containing vessel it preferably has a higher specific weight than liquid present in the vessel preventing the flotation of the device. This may be achieved by adding weights into the non-floating devices (8). Furthermore, at one end of the device (8), said non-floating devices (8) may have a means to attach (10) it to the bottom-surface (floor) of the liquid-containing vessel herein. Any means suitable to attach (10) the device to the bottom-surface of the liquid-containing vessel may be used. Preferably, said means to attach (10) it to the bottom-surface of the liquid-containing vessel may be: a suction cup or a set thereof, wherein a suction force keeps the device attached to the bottom-surface; a magnet attached to the bottom-surface and/or the non-floating device; and/or the attachment of the device to the bottom-surface using an adhesive.

Furthermore, it is preferred in the preferred embodiment wherein the device herein is a non-floating device (8), that the spray nozzle (2) or set of spray nozzles as described herein, when present, are located on the other end of the device (8) as compared to the means to attach (10) it to the bottom of the surface of the liquid-containing vessel herein, when present. By "other end of the device as compared to the means to attach (10) it to the bottom of the surface" it meant herein, either the opposite side of the device as compared to the means to attach (10) it to the bottom of the surface or the regions of the non-floating devices (8) close by the opposite side.

In another preferred embodiment herein, the spray nozzle (2) or set of spray nozzles as described herein, when present, are distributed over the length of the non-floating device (8) as described herein, enabling the device to apply a liquid onto the inner surfaces of the vessel to be cleaned at different heights. Said spray nozzles (2) distributed over the length of the non-floating device (8) may either discharge liquid during the entirety of the process herein or may start and/or stop discharging liquid during the process herein. In the preferred embodiment herein, wherein the liquid-containing vessel is drained during the process of cleaning, the spray nozzles (2), when present, start to discharge liquid as soon as said nozzles (2) are above the liquid surface. Preferably, the device (8) herein is equipped with an extendable part (12), which is equipped with least one spray nozzle (2). Said extendable part (12) may be extended by the user of the non-floating device (8) herein, after, prior or during the placement of the non-floating device (8) in the liquid-containing vessel to be cleaned, adapting the height of the device to the height of the vessel to be cleaned in order to avoid spilling of liquid to be discharged through the spray nozzles (2) over the rim of the vessel and/or complete coverage of the inner-surfaces of the vessel to be cleaned with liquid to be discharged through the spray nozzles (2). Furthermore, said extendable part (12) allows easier storage of the non-floating devices (8) herein.

Furthermore, the non-floating devices (8) herein may be equipped with a handle (9), allowing the user of the non-floating devices (8) herein to place and remove said devices in the liquid-containing vessel. Furthermore, said handle (9) may allow the adjustment of the extendable part (12), when present, of the non-floating devices (8) herein.

Cleaning Composition

The cleaning composition herein may comprise conventional cleaning ingredients, in particular ingredients suitable to clean hard surfaces. Preferably, the composition herein may comprise compounds selected from the group consisting of surfactants, solvents, bleaches, stabilizing agents, chelating agents, builder systems, radical scavengers, perfumes, dyes, suds suppressing agents, photobleaching agents, and minors, and mixtures thereof.

Docking Station

The automatic cleaning device herein may be combined in a kit together with a docking station (11). The docking station (11) may be built in a way to be suitable as a storage device for the automatic cleaning device herein. Preferably, the docking station (11) has a shape complementary to the shape of the cleaning device or is in any other way suitable to hold and/or attach thereto the automatic cleaning device herein.

In a preferred embodiment herein, the docking station (11) is equipped with a device for recharging the rechargeable battery pack of the automatic cleaning device, such as an electricity transformer, and may therefore be connected to the main current. Preferably, the process of the rechargeable battery pack of the automatic cleaning device is performed automatically each time the automatic cleaning device is placed on the docking station (11).

In another preferred embodiment herein, the docking station (11) is equipped with a storage tank for the cleaning composition used in the process according to the present invention. It is in this preferred embodiment, wherein the cleaning composition reservoir of the automatic cleaning device may be filled or refilled with cleaning composition from the storage tank for cleaning composition in the docking station (11), when the automatic cleaning device is placed on the docking station (11). Preferably, the process of (re)filling the cleaning composition reservoir from the cleaning composition storage tank is performed automatically each time the automatic cleaning device is placed on the docking station (11).

What is claimed is:

1. A process of cleaning the inner surfaces of a liquid-containing vessel with an automatic cleaning device, wherein said process is performed by said device and comprises the steps of applying a cleaning composition onto at least portions of the inner surface of said liquid-containing vessel and rinsing at least portions of the inner surface of said liquid-containing vessel and wherein said automatic cleaning device is a non-floating device placed on the bottom of said vessel and wherein said device is equipped with a means to attach it to the bottom of the surface of the liquid containing-vessel.

2. A process according to claim 1, wherein said liquid-containing vessel is a bathtub or a swimming pool.

3. A process according to claim 1, wherein said automatic cleaning device is equipped with a spray nozzle or a set thereof to apply said cleaning composition onto the inner surfaces of said liquid-containing vessel.

4. A process according to claim 1, wherein the inner surfaces of said vessel herein are rinsed with liquid present in said vessel.

5. A process according to claim 1, wherein said automatic cleaning device is equipped with a pumping means.

6. A process according to claim 1, wherein said automatic cleaning is equipped with an energy storage means.

7. A process according to claim 1, wherein said automatic cleaning is equipped with a disposable battery or a rechargeable battery pack.

8. A process according to claim 1, wherein said automatic cleaning is equipped with a reservoir for said cleaning composition.

9. A process according to claim 1, wherein said automatic cleaning is equipped with a filter.

10. A process according to claim 1, wherein said composition comprises compounds selected from the group consisting of surfactants, solvents, bleaches, stabilizing agents, chelating agents, builder systems, radical scavengers, perfumes, dyes, suds suppressing agents, photobleaching agents, and other minors, and mixtures thereof.

11. A process according to claim 1, wherein said automatic cleaning is combined in a kit together with a docking station, wherein said docking station is optionally equipped with a device for recharging a rechargeable battery pack of the automatic cleaning device and/or a storage tank for cleaning composition used in the process according to the present invention.

* * * * *